US010246657B2

(12) United States Patent
Shi et al.

(10) Patent No.: US 10,246,657 B2
(45) **Date of Patent: *Apr. 2, 2019**

(54) FUEL BLENDS FOR HOMOGENEOUS CHARGE COMPRESSION IGNITION ENGINES

(71) Applicant: PHILLIPS 66 COMPANY, Houston, TX (US)

(72) Inventors: Yu Shi, Bartlesville, OK (US); Garry C. Gunter, Bartlesville, OK (US); Bradley M. Taylor, Tulsa, OK (US)

(73) Assignee: Phillips 66 Company, Houston, TX (US)

( * ) Notice: Subject to any disclaimer, the term of this patent is extended or adjusted under 35 U.S.C. 154(b) by 243 days.

This patent is subject to a terminal disclaimer.

(21) Appl. No.: 14/551,319

(22) Filed: Nov. 24, 2014

(65) Prior Publication Data

US 2015/0159100 A1 Jun. 11, 2015

Related U.S. Application Data

(60) Provisional application No. 61/914,607, filed on Dec. 11, 2013.

(51) Int. Cl.
*C10L 1/08* (2006.01)
*C10L 1/04* (2006.01)

(52) U.S. Cl.
CPC ..... *C10L 1/08* (2013.01); *C10L 1/04* (2013.01); *C10L 2270/026* (2013.01); *C10L 2300/40* (2013.01)

(58) Field of Classification Search
CPC ..... C10L 1/08; C10L 1/04; C10L 2300/40; C10L 2270/026
See application file for complete search history.

(56) References Cited

U.S. PATENT DOCUMENTS

| | | | | |
|---|---|---|---|---|
| 2,360,585 | A * | 10/1944 | Boldt | C10L 1/06 208/17 |
| 5,553,575 | A | 9/1996 | Beck et al. | |
| 6,761,745 | B2 | 7/2004 | Hull et al. | |
| 7,487,663 | B2 | 2/2009 | Sobotowski et al. | |
| 9,376,640 | B2 * | 6/2016 | Cannella | C10L 1/04 |
| 2009/0025279 | A1 | 1/2009 | Lamprecht et al. | |
| 2009/0151236 | A1 | 6/2009 | Shibata | |

OTHER PUBLICATIONS

Shibata, Gen; Auto-Ignition Characteristics of Hydrocarbons and development of HCCI Fuel Index; SAE Technical Paper Series; 2007-01-0220.

Yao, Mingfa; Progress and recent trends in Homogeneous Charge Compression Ignition (HCCI) Engines; Progress in Energy and Combusion Science 35 (2009) 398-437.

Starck, L.; Impact of fuel characteristics on HCCI combustion: Performances and emissions; Fuel 89 (2010) 3069-3077.

(Continued)

*Primary Examiner* — Cephia D Toomer
(74) *Attorney, Agent, or Firm* — Phillips 66 Company

(57) ABSTRACT

The present disclosure relates to novel hydrocarbon fuel blends that provide increased power and a broader operating range when utilized as fuel for homogeneous charge compression ignition engines.

18 Claims, 7 Drawing Sheets

(56) References Cited

OTHER PUBLICATIONS

SAE Technical Paper Series; Auto-Ignition Characteristics of Hydrocarbons and Development of HCCI Fuel Index; 2007 World Congress, Detroit, Michigan, Apr. 16-19, 2007.
Progress in Energy and Combusion Science 35 (2009) 398-437; Progress and recent trends in homogeneous charge compression ignition (HCCI) engines; Mingfa Yao et al.
Fuel 89 (2010) 3069-3077; Impact of fuel characteristics on HCCI combustion: Performances and emissions; L. Starck et al.

* cited by examiner

FUEL BLENDS FOR HOMOGENEOUS CHARGE COMPRESSION IGNITION ENGINES

CROSS-REFERENCE TO RELATED APPLICATIONS

This application is a non-provisional application which claims the benefit of and priority to U.S. Provisional Application Ser. No. 61/914,607 filed Dec. 11, 2013, entitled "Fuels Blends for Homogeneous Charge Compression Ignition Engines," which is hereby incorporated by reference in its entirety.

BACKGROUND

More stringent engine emission standards regulated by the Environmental Protection Agency (EPA) provide incentive to study and to apply advanced combustion modes in internal combustion engines. Among recently proposed advanced combustion modes, the Homogeneous Charge Compression Ignition (HCCI) engine stands out as a very promising technology with better fuel economy and lower pollutant emissions compared to conventional diesel and gasoline engines. HCCI utilize a pre-mixed homogeneous charge of air/fuel, which is auto-ignited by engine compression and burns quickly to maximize combustion efficiency. As a result, the fuel chemistry plays a dominant role in combustion phasing and engine performance.

One of the major hurdles to creating commercially viable HCCI engines is developing technology to extend the engine high load limit. Because the chemical kinetics control combustion, the chemical properties of fuel components play a dominant role in HCCI engine performance. Combustion stability can also be a problem for HCCI engines under low load condition due to large cycle variations, i.e., during engine idling. This requires a fuel that has slow burning rate under high load but is still reactive under low load condition for HCCI engines. Accordingly, a need exists for improved hydrocarbon fuels that provide increased power and a broader operating range in HCCI engines, including increased load limit.

BRIEF SUMMARY OF THE DISCLOSURE

The invention generally relates to fuels and processes for making fuels that provide improved performance when combusted in a homogeneous charge compression ignition engine. In certain embodiments, the invention relates to a fuel for a homogeneous charge compression ignition engine that comprises a mixture of hydrocarbons, each hydrocarbon in the mixture comprising from 4 to 14 carbon atoms, at least 20 wt. % n-paraffins, at least 20 wt. % naphthenes, 20 wt. % or less of aromatic hydrocarbons and 5 wt. % or less of olefins. Optionally, at least 90 wt. % of the mixture of hydrocarbons may consist of hydrocarbons comprising from 6 to 10 carbon atoms, or at least 75 wt. % of the mixture of hydrocarbons may consist of hydrocarbons comprising from 7 to 9 carbon atoms. In certain embodiments, 15 wt. % or less, or optionally 10 wt. % or less of the hydrocarbons contain five or fewer carbon atoms.

In certain alternative embodiments, the fuel may optionally comprise at least 25 wt. %, at least 30 wt %, or even at least 35 wt. % of n-paraffins. The fuel may optionally comprise at least 25 wt. % of naphthenes, at least 30 wt. % of naphthenes, or at least 35 wt. % of naphthenes. In certain embodiments, the fuel may optionally comprise 15 wt. % or less of aromatics, or even 10 wt. % or less of aromatics.

In certain alternative embodiments, the fuel may additionally comprise 3 wt. % or less, 2 wt. % or less, or even 1 wt. % or less of olefins. In various embodiments, the fuel may additionally possess a dry vapor pressure equivalent (as measured by method ASTM-D5191) at 37.8° C. of 10 psi (69 kPa) or less, 9 psi (62 kPa) or less, 8 psi (55 kPa) or less, 7 psi (48 kPa) or less, or even 6 psi (41 kPa) or less. In certain embodiments, the fuel preferably contains a quantity (wt. %) of naphthenes that is greater than the quantity (wt. %) of normal paraffins.

Certain embodiments of the present invention relate to a process for making a fuel for a homogeneous charge compression ignition engine. In certain embodiments, the process comprises blending hydrocarbons to form a fuel mixture, where the power index of the fuel mixture when combusted in a homogeneous charge compression engine is greater than or equal to 1.5. The power index is defined by the equation:

$$\text{Power Index}=(\text{AREA}x*\text{MIMEP}x)/(\text{AREA}y*\text{MIMEP}y)$$

where MIMEP is the maximum indicated mean effective pressure achieved inside a homogeneous charge compression ignition engine cylinder during combustion of the fuel mixture (x) or the reference fuel (y), respectively, and an equal mass of each fuel is combusted. The variable y is a reference fuel comprising 11 wt. % n-heptane, 37 wt. % iso-octane, 32 wt. % toluene, 11 wt. % methyl-cyclohexane and 9 wt. % 1-hexene, while AREAx and AREAy represent distinct areas on a graph of load (IMEP) versus engine revolutions per minute (RPM) for the fuel mixture (x) and the reference fuel (y), respectively, each distinct area having an upper bound at the IMEP during combustion of each fuel at an RPM ranging from 1500 RPM to 2500 RPM, and having a lower boundary at the IMEP below which combustion of each fuel becomes unstable at an engine RPM ranging from 1500 RPM to 2500 RPM. In certain embodiments, the power index of the fuel mixture is greater than or equal to 1.75, or even greater than or equal to 2.

Certain embodiments of the process comprise blending hydrocarbons into a fuel mixture that comprises hydrocarbons containing from 4 to 14 carbon atoms, at least 20 wt. % n-paraffins, at least 20 wt. % napthenic hydrocarbons, 20 wt. % or less of aromatic hydrocarbons and 5 wt. % or less of olefins. In certain embodiments of the process, at least 90 wt. % of the fuel mixture consists of hydrocarbons containing from 6 to 10 carbon atoms. In certain embodiments, at least 75 wt. % of the fuel mixture consists of hydrocarbons containing from 7 to 9 carbon atoms. In certain embodiments of the process, 15 wt. % or less, or optionally 10 wt. % or less of the hydrocarbons in the fuel mixture contain five or fewer carbon atoms.

In certain embodiments of the process, the fuel mixture may comprise at least 25 wt. % or at least 30 wt. % of n-paraffins. Optionally, the fuel mixture may comprise at least 25 wt. %, at least 30 wt. %, or even at least 30 wt. % of naphthenic hydrocarbons. In certain embodiments of the process, the fuel mixture comprises 15 wt. % or less, or even 10 wt. % or less of aromatic hydrocarbons.

Optionally, the fuel mixture of the process may additionally comprise 3 wt. % or less, 2 wt. % or less, or even 1% or less of olefins. Optionally, the fuel mixture of the process possesses a dry vapor pressure equivalent (as measured by method ASTM-D5191) at 37.8° C. of 10 psi (69 kPa) or less, 9 psi (62 kPa) or less, 8 psi (55 kPa) or less, 7 psi (48 kPa)

or less, or even 6 psi (41 kPa) or less. In certain embodiments of the process, the quantity (wt. %) of napthenic hydrocarbons in the fuel mixture is greater than the quantity (wt. %) of normal paraffins in the fuel mixture.

BRIEF DESCRIPTION OF THE DRAWINGS

A more complete understanding of the present invention and benefits thereof may be acquired by referring to the follow description taken in conjunction with the accompanying drawings in which.

Figure 1:
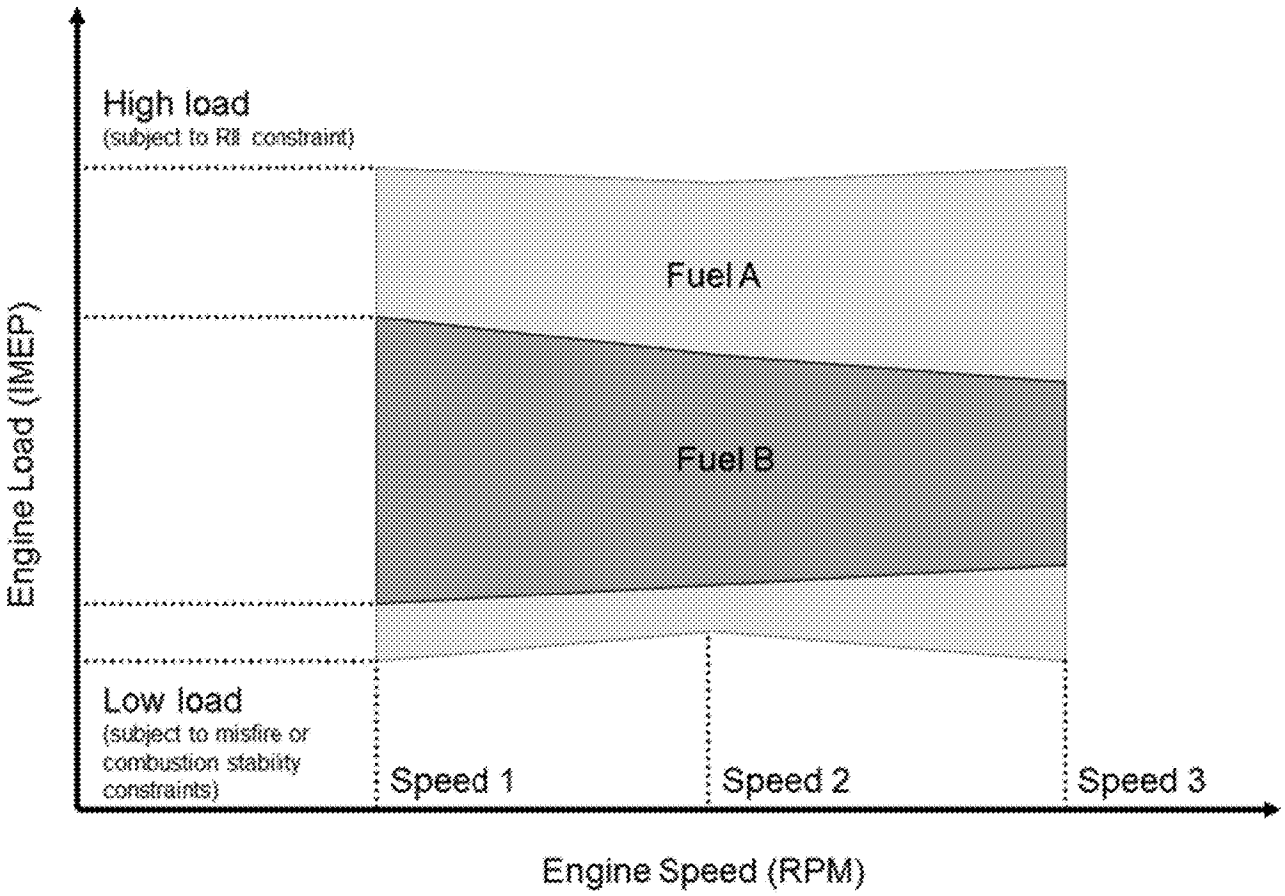
FIG. 1 depicts a hypothetical speed versus load (IMEP) map of two fuels, A and B, over a range of engine speeds expressed in revolutions per minute (RPM).

The invention is susceptible to various modifications and alternative forms, specific embodiments thereof are shown by way of example in the drawings. The drawings may not be to scale. It should be understood that the drawings and their accompanying detailed descriptions are not intended to limit the scope of the invention to the particular form disclosed, but rather, the intention is to cover all modifications, equivalents and alternatives falling within the spirit and scope of the present invention as defined by the appended claims.

DETAILED DESCRIPTION

The present disclosure pertains to the properties and chemical components that make a novel fuel that improves the performance of HCCI engines. The properties include improved engine operating limits as well as increased power and efficiency. We assessed the performance of seven low-octane fuel blends and nine high-octane fuel blends on an HCCI engine utilizing a high-fidelity computer simulation tool. Each simulated fuel blend was constructed to comprise different combinations of eight chemical compounds, with each compound representing a distinct chemical genus, including n-paraffins, iso-paraffins, aromatics, naphthenes and olefins (hereinafter referred to as PIANO compounds). From this work, we derived an equation that correlates the presence of each PIANO hydrocarbon component in a fuel blend to the relative performance of that fuel blend for HCCI combustion. We then tested several hydrocarbon fuel blends in an actual HCCI engine to confirm the results of our modeling work and demonstrate that the presence of certain chemical species strongly correlates with increased fuel performance, while the presence of other chemical species inversely correlates with increased fuel performance.

The examples are intended to be illustrative of specific embodiments in order to teach one of ordinary skill in the art how to make and use the invention. These examples should not be interpreted to limit, or define, the scope of the invention to less than is fully encompassed by the full disclosure of the invention herein and its legal equivalents.

Example 1

HCCI engine combustion was modeled using the Chemkin software and the detailed gasoline mechanisms developed by Reaction Design of San Diego, Calif. A single zone HCCI engine model was used to simulate HCCI engine combustion. The modeled test engine had the specifications listed in Table 1.

TABLE 1

| Test Engine Specifications | |
|---|---|
| Bore diameter (cm) | 8.6 |
| Displacement volume ($cm^3$) | 500 |
| IVC (aTDC) | −136 |
| EVO (aTDC) | 138 |
| Engine connecting rod to crank radius ratio | 3.326 |

Test fuels were formulated to have either a high octane number (HON) corresponding to about 91 RON, or low octane number (LON) corresponding to about 60 RON. Fuels were formulated by blending eight fuel components, including n-heptane, n-hexane, iso-octane, methyl-pentane (iso-hexane), toluene, ethyl-benzene, methyl-cyclohexane (mch), and 1-hexene. The percentage of the individual chemical component was varied in the different test fuels to assist in determining the relative impact of each chemical component on HCCI engine combustion while still maintaining the targeted 91 RON and 60 RON of the surrogate fuels. The RONs of the surrogates were calculated based on the mass percentage of each fuel component and its corresponding RON. Table 2 provides the fuel composition, RON, and MON (based on linear expressions using fuel mass fractions) for the 16 gasoline surrogates studied. HON1 to HON9 represent the nine HON gasoline fuels, and LON1 to LON7 represent the seven LON fuels.

TABLE 2

Hypothetical Fuel Blends Modeled

| | #n-heptane | n-hexane | i-octane | i-hexane | toluene | ethyl-benzene | MCH | 1-hexene | RON | MON |
|---|---|---|---|---|---|---|---|---|---|---|
| HON1 | 11.0% | 0.0% | 37.0% | 0.0% | 32.0% | 0.0% | 11.0% | 9.0% | 90.3 | 85.7 |
| HON2 | 0.0% | 15.0% | 33.0% | 0.0% | 34.0% | 0.0% | 10.0% | 8.0% | 90.9 | 86.4 |

TABLE 2-continued

| Hypothetical Fuel Blends Modeled | | | | | | | | | | |
|---|---|---|---|---|---|---|---|---|---|---|
| | #n-heptane | n-hexane | i-octane | i-hexane | toluene | ethyl-benzene | MCH | 1-hexene | RON | MON |
| HON3 | 10.0% | 0.0% | 43.0% | 0.0% | 29.0% | 0.0% | 10.0% | 8.0% | 91.2 | 87.1 |
| HON4 | 0.0% | 10.0% | 33.0% | 0.0% | 29.0% | 0.0% | 20.0% | 8.0% | 91.1 | 87.1 |
| HON5 | 0.0% | 10.0% | 33.0% | 0.0% | 29.0% | 0.0% | 10.0% | 18.0% | 91.3 | 86.0 |
| HON6 | 10.0% | 0.0% | 25.0% | 8.0% | 39.0% | 0.0% | 10.0% | 8.0% | 91.0 | 85.9 |
| HON7 | 0.0% | 12.0% | 41.0% | 0.0% | 25.0% | 0.0% | 12.0% | 10.0% | 90.4 | 86.6 |
| HON8 | 10.0% | 0.0% | 33.0% | 0.0% | 8.0% | 30.0% | 10.0% | 9.0% | 90.2 | 84.2 |
| HON9 | 0.0% | 12.0% | 41.0% | 0.0% | 26.0% | 0.0% | 12.0% | 9.0% | 90.8 | 87.0 |
| LON1 | 32.0% | 0.0% | 27.0% | 0.0% | 8.0% | 0.0% | 33.0% | 0.0% | 60.9 | 60.1 |
| LON2 | 0.0% | 39.0% | 9.0% | 15.0% | 7.0% | 0.0% | 30.0% | 0.0% | 60.2 | 59.9 |
| LON3 | 10.0% | 19.0% | 0.0% | 34.0% | 7.0% | 0.0% | 30.0% | 0.0% | 60.2 | 59.7 |
| LON4 | 29.0% | 0.0% | 17.0% | 7.0% | 7.0% | 0.0% | 40.0% | 0.0% | 60.0 | 59.3 |
| LON5 | 29.0% | 0.0% | 16.0% | 8.0% | 7.0% | 0.0% | 30.0% | 10.0% | 60.0 | 58.0 |
| LON6 | 29.0% | 0.0% | 0.0% | 24.0% | 17.0% | 0.0% | 30.0% | 0.0% | 60.1 | 58.3 |
| LON7 | 20.0% | 14.0% | 30.0% | 0.0% | 0.0% | 0.0% | 36.0% | 0.0% | 60.0 | 60.2 |

In order to examine the fuel performance under a variety of operating conditions, six engine parameters were varied, including engine compression ratio, speed, initial temperature, initial pressure, EGR (Exhaust Gas Recirculation) rate, and equivalence ratio. Table 3 summarizes the variables and their values studied in this work, although not all data obtained are reproduced here or are necessary for a full understanding of the invention disclosed herein.

TABLE 3

| Computer Modeled Engine Parameters | |
|---|---|
| Compression ratio | 12, 13, 14 |
| Engine speed (rpm) | 1000, 1500, 2000 |
| Initial temperature (K) | 375, 425, 475 |
| Initial pressure (atm) | 1, 1.5, 2.0 |
| EGR (%) | 30, 40, 50, 60 |
| Equivalence ratio | 0.5, 0.6, 0.7, 0.8 |

Practical HCCI engine operation is subject to different constraints. Specifically, the high load limit of engine operation is usually restricted by the maximum pressure rise rate during the combustion. A high pressure rise rate is the direct cause of engine knocking and may lead to severe mechanical damage. The Ringing Intensity Index (RII) was defined in the literature by J. A. Eng[1] to quantify the knocking intensity in HCCI engines. RII is calculated using the equation:

$$RII = \frac{1}{2\gamma}\frac{\left(\beta\left(\frac{dP}{dt}\right)_{max}\right)^2}{P_{max}}\sqrt{\gamma R T_{max}}$$

where $$\left(\frac{dP}{dt}\right)_{max}$$

is maximum pressure rise rate in the cylinder, kPa/msec $\beta$=0.05 is a scaling factor msec $P_{max}$ is maximum pressure in the cylinder, Pa $T_{max}$ is maximum temperature in the cylinder, K R is the gas constant, J/kg K $\gamma$ is the ratio of specific heats $C_p/C_v$ In our computer modeling, the limit of RII was set to 5 MW/m2 and defined the highest possible engine load condition when running with different fuel blends. The lower limit of the accessible engine load is determined by either misfire or an unstable combustion condition. In our modeling, a maximum in-cylinder temperature below 1300 K was deemed to result in a misfire. Unstable combustion was defined as that occurring later than 19° aTDC (after Top Dead Center) and is a typical constraint on the operability of an HCCI engine.

It is common for HCCI fuel performance to be measured by maximum Indicated Mean Effective Pressure (IMEP) in the cylinder without violating the RII constraint (defined above). IMEP can be used as a fuel performance metric applicable to engines running with a constant speed and when the high load limit is of primary concern. However, in addition to the high load limit, the low load boundary (either misfire or unstable combustion) is also of concern when assessing the fuel performance. IMEP also does not give a full assessment of fuel performance over a range of HCCI engine speeds. Therefore, we developed a new metric, termed Power Index (PI), that can quantify HCCI fuel performance over the entire engine operating range. The engine operating range is constrained by RII, maximum in-cylinder temperature, and the maximum crank angle (expressed as degrees after top dead center) at which stable combustion can be maintained (i.e., without excessive misfire or cyclical variation). The performance of a given HCCI fuel blend typically falls within these engine operating constraints, and can be established on an engine speed-load map. FIG. 1 depicts a hypothetical speed-load map of two fuels, A and B, over a range of engine speeds (expressed in revolutions per minute, or RPM). The maximum IMEP at each speed provides the upper limit, while the minimum limit at each speed is represented by the IMEP at which combustion becomes unstable due to misfire or unacceptable cyclic variation of the engine that may be caused by a lean condition or adjustments to negative valve overlap. Accordingly, we define the Power Index (PI) for a fuel as:

$$\text{Power Index}=(\text{Area}_{test\ fuel}*\text{Max IMEP}_{test\ fuel})/(\text{Area base}_{reference\ fuel}*\text{Max IMEP reference}_{fuel})$$

where the Area represents the operating range of either the test fuel or the base fuel on the speed-load map. The high octane number fuel surrogate HON1 in Table 2 was selected as the base fuel for this modeling work, and was arbitrarily assigned a PI of 1. In alternative embodiments, an alternative base (i.e., reference) fuel may be chosen. For example, in certain embodiments, the base (reference) fuel may comprise 50 wt. % n-heptane and 50 wt. % iso-octane. In the modeling work, a larger calculated PI value was indicative of a fuel blend having better overall performance for HCCI engine combustion.

Parametric modeling studies were conducted for each surrogate fuel blend on HCCI engine combustion based on the variables provided in Tables 1-3. The area of the engine speed-load map for each fuel blend was calculated and used to calculate Power Index according to the above equation. The results are provided in Table 4, and show that the calculated PI for the LON fuels were larger than the PI of the HON fuels. Indeed, the calculated PI for all HON fuels was close to the base fuel HON1, with a PI of 1. Thus, LON fuels (target RON 60) were deemed preferable as a HCCI fuel versus the HON fuels (target RON of 91).

Table 4 summarizes the actual values of the PI and maximum engine load (IMEP) at both 1000 and 1500 RPM for each modeled fuel blend. Results were also obtained at 2000 RPM for each fuel, but are not shown.

TABLE 4

Calculated Power Index and Maximum Achievable Load at 1000 RPM and 1500 RPM

| Fuel Name | Power Index | Maximum load (bar) (1000 rpm) | Maximum load (bar) (at 1500 rpm) |
|---|---|---|---|
| HON1 | 1 | 6.81 | 6.00 |
| HON2 | 1.07 | 6.95 | 5.68 |
| HON3 | 0.97 | 6.75 | 5.98 |
| HON4 | 1.25 | 6.71 | 5.95 |
| HON5 | 0.95 | 6.93 | 5.70 |
| HON6 | 0.91 | 6.83 | 6.02 |
| HON7 | 1.10 | 6.90 | 5.67 |
| HON8 | 0.91 | 6.98 | 5.91 |
| HON9 | 1.09 | 6.89 | 6.01 |
| HON fuels avg. | 1.03 | 6.86 | 5.88 |
| LON1 | 2.21 | 8.98 | 9.15 |
| LON2 | 2.29 | 8.97 | 9.13 |
| LON3 | 2.04 | 8.89 | 9.29 |
| LON4 | 2.34 | 9.73 | 9.27 |
| LON5 | 2.04 | 9.02 | 7.76 |
| LON6 | 2.02 | 9.31 | 6.96 |
| LON7 | 2.37 | 9.07 | 9.16 |
| LON fuels avg. | 2.19 | 9.14 | 8.67 |

The LON5 fuel was the only LON fuel containing 1-hexene, indicating that this species, and perhaps olefins in general, may have adversely affected the performance of this LON fuel blend. Meanwhile, the performance of the HON fuels appeared to be relatively insensitive to the presence of olefins.

LON6 had the largest toluene content among all LON fuels. While not wishing to be bound by theory, this may have resulted in a lower reactivity of LON6 relative to other LON fuel blends tested, leading to a lower PI because higher intake temperature (resulting in less air/fuel charge to the cylinder according to the ideal gas law) was required to ignite the fuel blend. The LON fuel with the highest PI was LON4. This fuel blend had the highest MCH content, which is consistent with naphthenic content benefitting HCCI engine combustion.

Example 2

We also modeled the effect of increased intake pressure on the properties of the different fuel blends, and the results are provided in Table 5.

TABLE 5

Power Index and Maximum Achievable Load at Different Intake Pressures

| Fuel Name | Power Index | Max. Load (bar) (at $P_{intake}$ = 1 atm) | Max. Load (bar) (at $P_{intake}$ = 1.5 atm) | Max. Load (bar) (at $P_{intake}$ = 2 atm) |
|---|---|---|---|---|
| HON1 | 1 | 3.43 | 5.15 | 6.81 |
| HON2 | 1.07 | 3.39 | 4.28 | 6.95 |
| HON3 | 0.97 | 3.33 | 4.73 | 6.75 |
| HON4 | 1.25 | 3.09 | 5.58 | 6.71 |
| HON5 | 0.95 | 3.13 | 4.20 | 6.93 |
| HON6 | 0.91 | 3.36 | 5.88 | 6.83 |
| HON7 | 1.10 | 3.11 | 4.49 | 6.90 |
| HON8 | 0.91 | 3.15 | 4.49 | 6.98 |
| HON9 | 1.09 | 3.43 | 5.15 | 6.81 |
| HON fuels avg. | 1.03 | 3.26 | 4.78 | 6.86 |
| LON1 | 2.21 | 3.36 | 5.62 | 9.15 |
| LON2 | 2.29 | 3.41 | 7.45 | 9.13 |
| LON3 | 2.04 | 2.99 | 6.71 | 9.29 |
| LON4 | 2.34 | 3.11 | 5.83 | 9.73 |
| LON5 | 2.04 | 3.36 | 6.92 | 9.02 |
| LON6 | 2.02 | 3.41 | 6.79 | 9.31 |
| LON7 | 2.37 | 3.09 | 4.49 | 9.16 |
| LON fuels avg. | 2.19 | 3.25 | 6.26 | 9.26 |

Both HON and LON fuel blends achieved similar maximum load (indicated in bar) at an intake pressure of 1 atm, suggesting that HCCI engine performance was not particularly sensitive to the fuel composition at atmospheric pressure. However, at 1.5 atm intake pressure, the LON fuel blends had significantly higher maximum load (IMEP) that the HON blends (Table 4). There was also significant variation in the IMEP achieved among the different LON fuel blends, indicating that the chemical composition of each fuel blend had a significant impact on its suitability for HCCI combustion. For example, at 1.5 atm intake pressure, the LON2 fuel reached 7.45 bar maximum load, while the LON7 fuel only achieved 4.49 bars.

Example 3

We examined the combustion rate for each component in a given fuel blend and plotted the results as mole fraction combusted versus engine crank angle. All fuel components except toluene were observed to rapidly decompose during an initial low temperature heat release stage, then gradually oxidize as combustion proceeded. We observed that toluene was consumed much slower than the other components, especially between the first and the second heat release stages. While not wishing to be bound by theory, the slow burning rate of toluene is theorized to help extend the combustion duration and reduce the engine ringing intensity. Thus, a small amount of aromatic species may be beneficial to HCCI engine combustion when blended into a low RON fuel.

Figure 2:
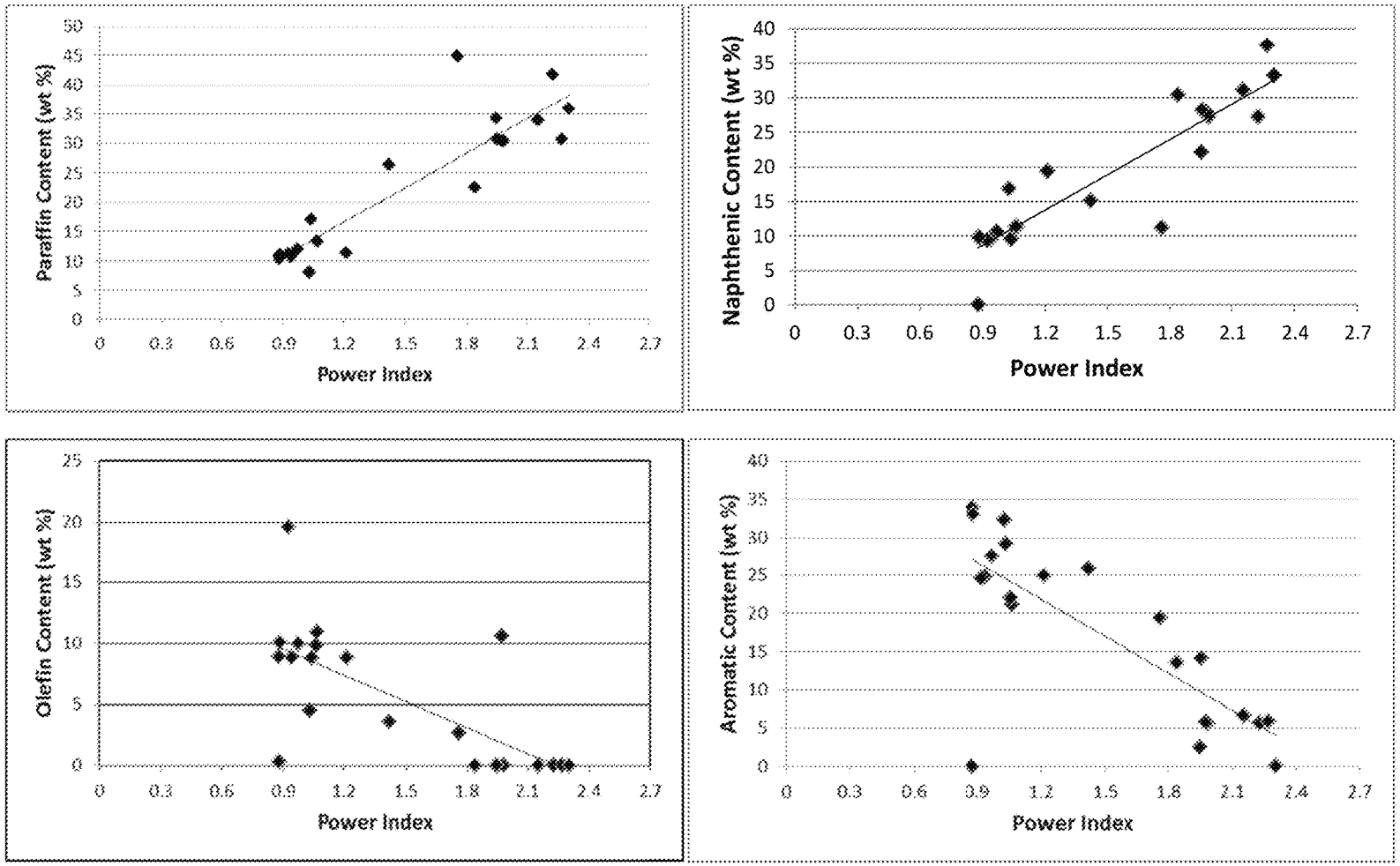
FIG. 2 comprises several graphs, each depicting a correlation between the power index for several fuel blends and the quantity of n-paraffins, naphthenes, olefins or aromatics present in each fuel blend.

The results for all fuel blends were analyzed statistically to derive correlation and covariance coefficients between the power index and the quantity of various PIANO groups present in each fuel. The correlations are shown in Table 6, and graphed in FIG. 2.

TABLE 6

| Correlation and Covariance Between Power Index and PIANO Groups | | | | | |
|---|---|---|---|---|---|
| Power index | Paraffin | Iso-paraffin | Aromatics | Naphthene | Olefin |
| Correlation coefficient | 0.949 | −0.743 | −0.791 | 0.957 | −0.932 |
| Covariance coefficient | 0.062 | −0.029 | −0.026 | 0.066 | −0.074 |

The correlation coefficients between the power index and the presence of normal paraffins and naphthenes were found to be close to 1, suggesting that normal paraffinic and naphthenic compounds were significant contributors to the Power Index of the LON fuel blends. The correlation coefficient for certain components (i.e., iso-paraffins, aromatic hydrocarbons, and olefins) was negative, suggesting that these groups were not beneficial. However, this does not necessarily indicate that these compounds must be completely removed to create an optimal HCCI fuel. For example, as mentioned above, a small amount of toluene in the LON fuels helped to extend the combustion duration, and thus, lower the ringing intensity. Also, the correlation and covariance coefficients between the PI and the individual fuel component unexpectedly indicated that iso-hexane (as opposed to iso-octane) actually had a positive influence on PI, as is summarized in Table 7. MCH indicates methyl cyclo-hexane.

TABLE 7

| Correlation and Covariance Between Power Index and Specific Fuel Component | | | | | | | | |
|---|---|---|---|---|---|---|---|---|
| Power index | n-heptane | n-hexane | i-octane | i-hexane | toluene | ethyl-benzene | mch | 1-hexene |
| Correlation coefficient | 0.656 | 0.216 | −0.742 | 0.550 | −0.844 | −0.208 | 0.957 | −0.791 |
| Covariance coefficient | 0.048 | 0.014 | −0.063 | 0.034 | −0.064 | −0.009 | 0.066 | −0.026 |

The correlation indicates that the diversity of the species in fuel blends is also a very important factor to Power Index. Both chemical composition and octane number are important to formulation of superior HCCI engine fuels, and the results provide support for several embodiments of the present invention.

Statistical analysis of all computer modeling performed yielded a correlation between the Power Index and presence of four of the five PIANO groups, including n-paraffin, iso-paraffin, aromatics, and naphthene (olefin is excluded because of the permutations and combinations rule in statistical analysis). This can be expressed as:

Power Index (PI)=0.46+2.39 Paraffin+0.12 Iso-paraffin+2.76 Naphthene−0.32 Aromatics where the overall fit has a coefficient of determination ($R^2$)=0.951.

Example 4

Empirical testing was performed in an actual HCCI engine to confirm the computer-modeled results discussed in the Examples 1-3. The University of Michigan Auto Lab performed tests utilizing a single cylinder HCCI engine having the specifications listed in Table 8. The experimental conditions under which testing was performed are listed in Table 9, while the general properties and composition of the fuel blends tested are listed in Table 10. RD387 was a commercial certified gasoline and was used as control for this work. NH-20 and NH-40 are simple control blends of 20 wt. % and 40 wt. % n-heptane mixed with RD387 certification gasoline. R9, IS5 and IS6A were non-commercial hydrocarbon test blends produced by Phillips 66 Company, Houston, Tex. for these tests. Table 11 shows a detailed analysis of the composition of each test fuel by carbon number.

TABLE 8

| Test Engine Specifications: | |
|---|---|
| Displacement volume (cm^3) | 550 |
| Cylinders | 1 |
| Stroke (mm) | 94.6 |
| Bore (mm) | 86 |
| Connecting rod length (mm) | 152.2 |
| Compression ratio | 12.5 |
| Number of valves | 4 |
| Piston shape | Shallow bowl |

TABLE 8-continued

| Test Engine Specifications: | |
|---|---|
| Head design | Pent-roof |
| Fuel delivery | Direct injection |

TABLE 9

| Experimental conditions | |
|---|---|
| Engine speed (rpm) | 2000 |
| Intake temperature (° C.) | 45 |
| Intake pressure (bar) | 1.0 |
| Exhaust pressure (bar) | 1.05 |
| Coolant temperature (° C.) | 90 |
| Oil temperature (° C.) | 90 |
| Ringing index limit (MW/m$^2$) | 5 |
| COV of IMEP limit (%) | 5 |
| EI-Nox limit (g/kg-fuel) | 1 |

TABLE 10

| Test Fuel Specifications | | | | | | |
|---|---|---|---|---|---|---|
| | RD387 | NH20 | NH40 | R9 | IS5 | IS6A |
| LHV (kJ/kg) | 43032 | 43445 | 43649 | 43665 | 44218 | 45202 |
| Density (g/ml) | 0.746 | 0.733 | 0.721 | 0.748 | 0.679 | 0.623 |
| RVP (psi) | 6.400 | — | — | 1.58 | 11.05 | 21.64 |
| MW (g/mol) | 93.039 | — | 95.776 | 108.1 | 82.6 | 71.4 |
| Carbon (wt %) | 86.4 | — | — | 85.6 | 84.2 | 83.2 |
| Hydrogen (wt %) | 13.6 | — | — | 14.4 | 15.8 | 16.8 |
| H/C (molar) | 1.897 | 1.959 | 2.039 | 2.002 | 2.235 | 2.403 |
| RON | 90.5 | 75 | 58 | 50 | 71 | 95 |
| MON | 82.6 | 71 | 56 | 50 | 69 | 88 |
| AKI ((R + M)/2) | 87 | 73 | 57 | 50 | 70 | 92 |
| Aromatics (wt %) | 32.3 | 25.8 | 19.4 | 13.5 | 2.5 | 0.0 |
| Paraffins (wt %) | 8.1 | 26.5 | 44.9 | 22.6 | 34.2 | 10.4 |
| Iso-paraffins (wt %) | 37.5 | 30.0 | 22.5 | 31.0 | 40.0 | 89.3 |
| Naphthenes (wt %) | 16.9 | 15.1 | 11.3 | 30.4 | 22.2 | 0.0 |
| Olefins (wt %) | 4.5 | 3.6 | 2.7 | 0 | 0 | 0.3 |

TABLE 11

| Composition of Each Test Fuel by Carbon Number (in wt. %) | | | | |
|---|---|---|---|---|
| Carbon Number | RD387 (wt. %) | IS5 (wt. %) | IS6a (wt. %) | R9 (wt. %) |
| C4 | 1.7 | 1.8 | 4.1 | — |
| C5 | 17.7 | 34.6 | 95.8 | 0.5 |
| C6 | 12.9 | 38.1 | — | 9.9 |
| C7 | 32.3 | 21.3 | — | 21.6 |
| C8 | 20.6 | 3.9 | — | 25.2 |
| C9 | 8.5 | 0.2 | — | 8.6 |
| C10 | 3.8 | — | — | 0.2 |
| C11 | 1.0 | — | — | — |

We examined the maximum engine load (MIMEP) achievable for each test fuel by "mapping" the operating range of each test fuel over a range of "negative valve overlap" (NVO) settings. NVO is the duration (measured in degrees) where the exhaust valve is closed prior to opening of the intake valve. The greater the NVO duration, the more exhaust, or residual, that is retained in the cylinder to a) dilute and b) preheat the incoming air/fuel mixture. For each fuel blend tested, the energy addition per engine cycle was held constant regardless of the NVO setting for each fuel by compensating the mass flow based on lower heating value (LHV) such that J/cycle was held constant. For this work, the energy addition per cycle was made independent of engine size by dividing by cylinder displacement volume. This resulted in a new metric, termed Energy Mean Effective Pressure (EMEP):

$$EMEP\ [\text{bar}] = \frac{\text{Energy Addition [J/cycle]}}{\text{Displacement Volume [L]} \times 100}$$

Figure 3:
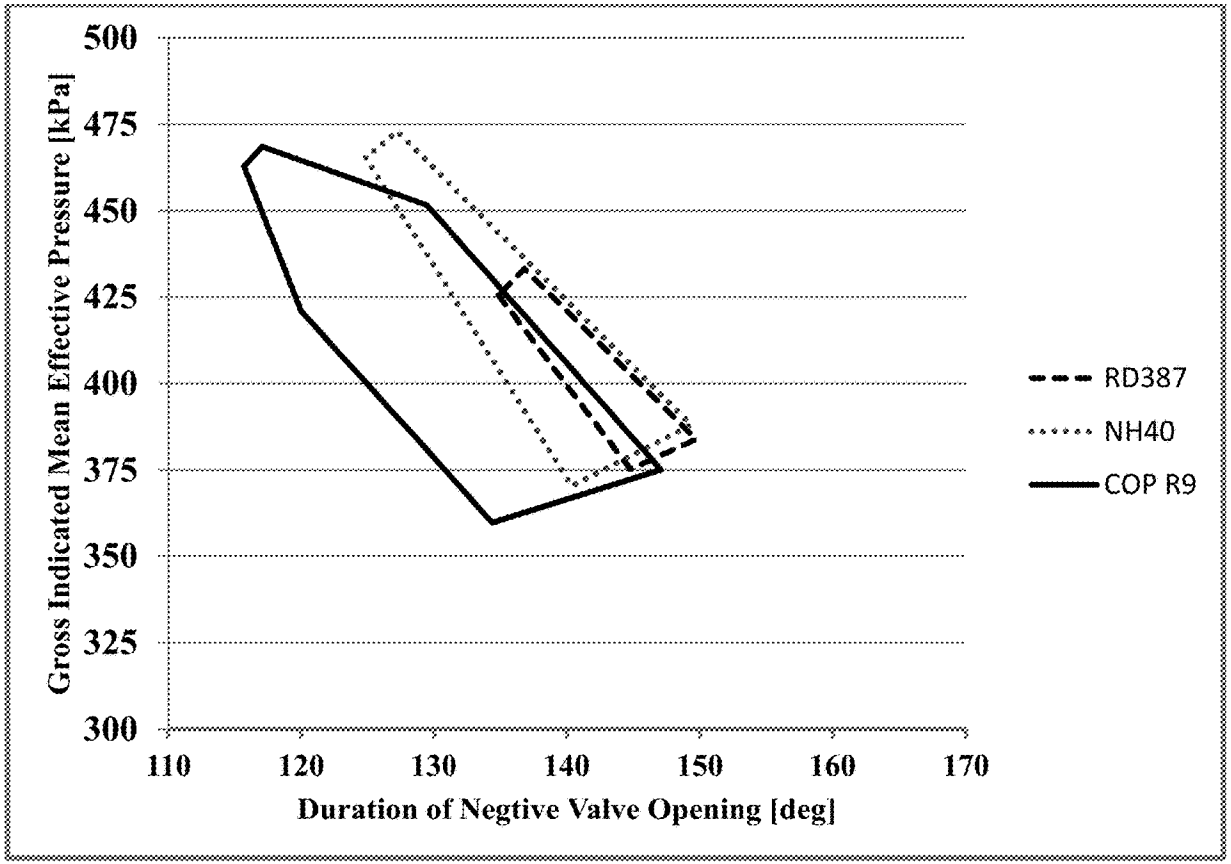
FIG. 3 is a graph that plots engine load (gross IMEP) versus negative valve overlap (NVO) as an indicator of operating range for several novel fuel blends versus certification gasoline (RD387).

The operating range of the R9 test fuel was compared to RD387 gasoline and NH40, as shown in FIG. 3, which plots gross IMEP versus the duration of NVO. The graph demonstrates that the amount of NVO required for stable HCCI combustion for R9 fuel was significantly less than that of NH40 fuel, even though they had similar calculated RON (refer to Table 10). This indicates that the superior properties of R9 as an HCCI fuel were not simply a consequence of its low octane number, but other physical and/or chemical properties.

Figure 4:
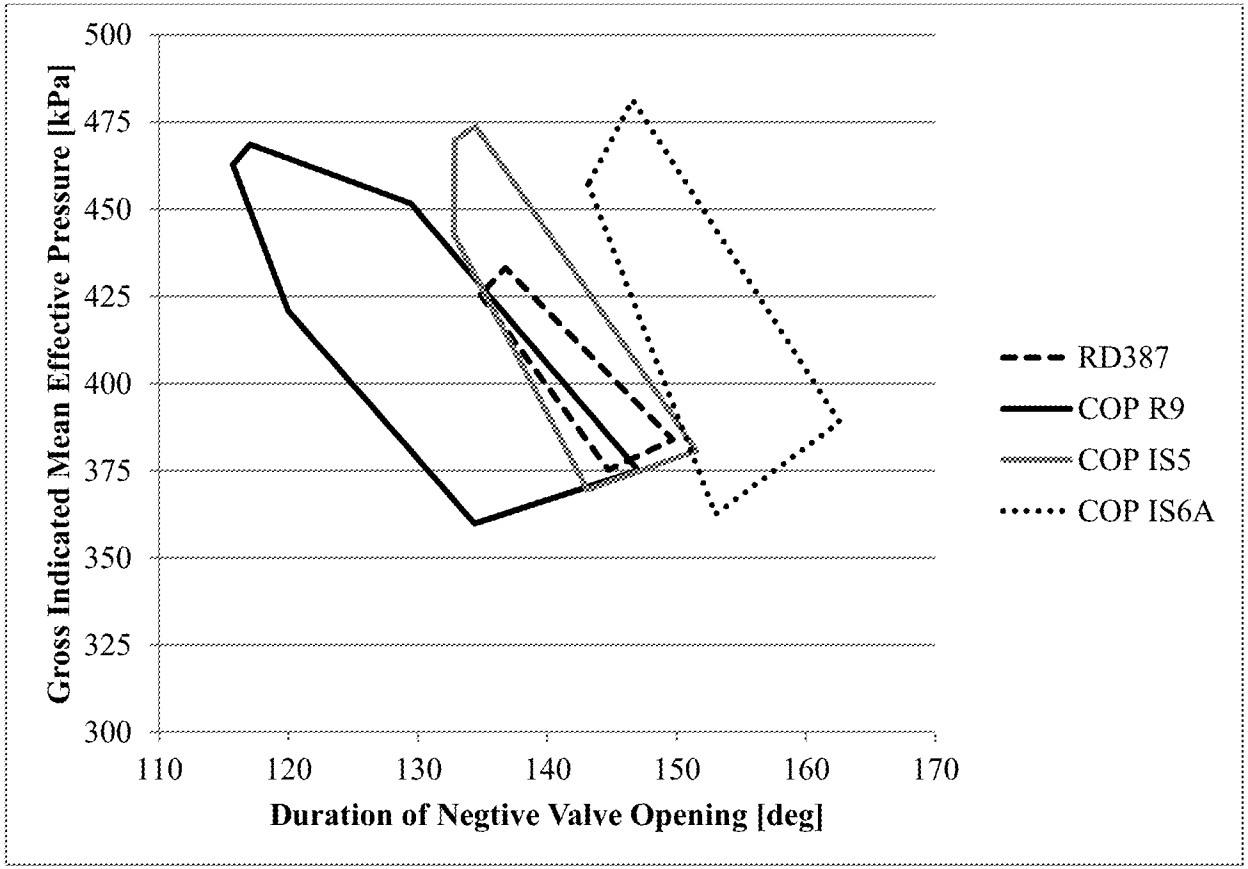
FIG. 4 is a graph depicting performance of certification gasoline (RD387) compared to several novel fuel blends with respect to negative valve overlap (NVO) during combustion in an HCCI engine.
Figure 5:
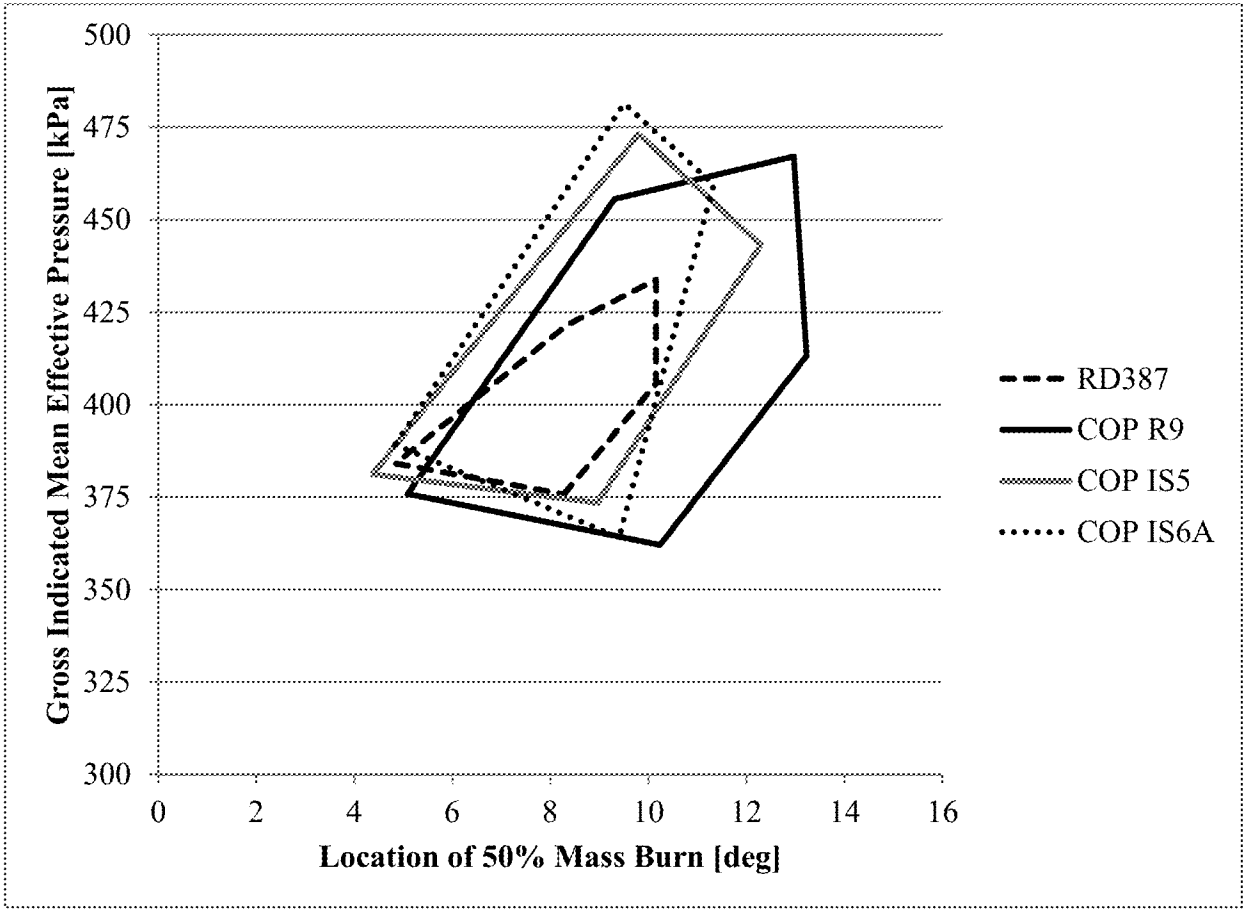
FIG. 5 is a graph depicting performance of several novel fuel blends with respect to combustion phasing (degrees after top dead center, or deg ATDC) during combustion in an HCCI engine.

The performance of the Phillips 66 Company test fuels with respect to their NVO range is compared in FIG. 4 and with respect to combustion phasing (timing advance) in FIG. 5. Although FIG. 4 shows test fuels IS5 and IS6A achieved slightly higher engine loads than R9 (IS6A achieved about 3% higher maximum IMEP than R9), R9 was able to sustain load (IMEP) at significantly less NVO, indicating that R9 is a more favorable HCCI fuel. FIG. 5 shows that the R9 fuel blend maintained load (IMEP) at significantly later combustion phasing (defined as degrees after top dead center at which 50 wt. % of the fuel charge burns), which also favored the R9 blend as an HCCI fuel versus RD387 certification gasoline and the IS5 or IS6 blends. Overall R9 was determined to be an improved blend versus the other test fuels over a the range of operating conditions utilized.

Figure 6:
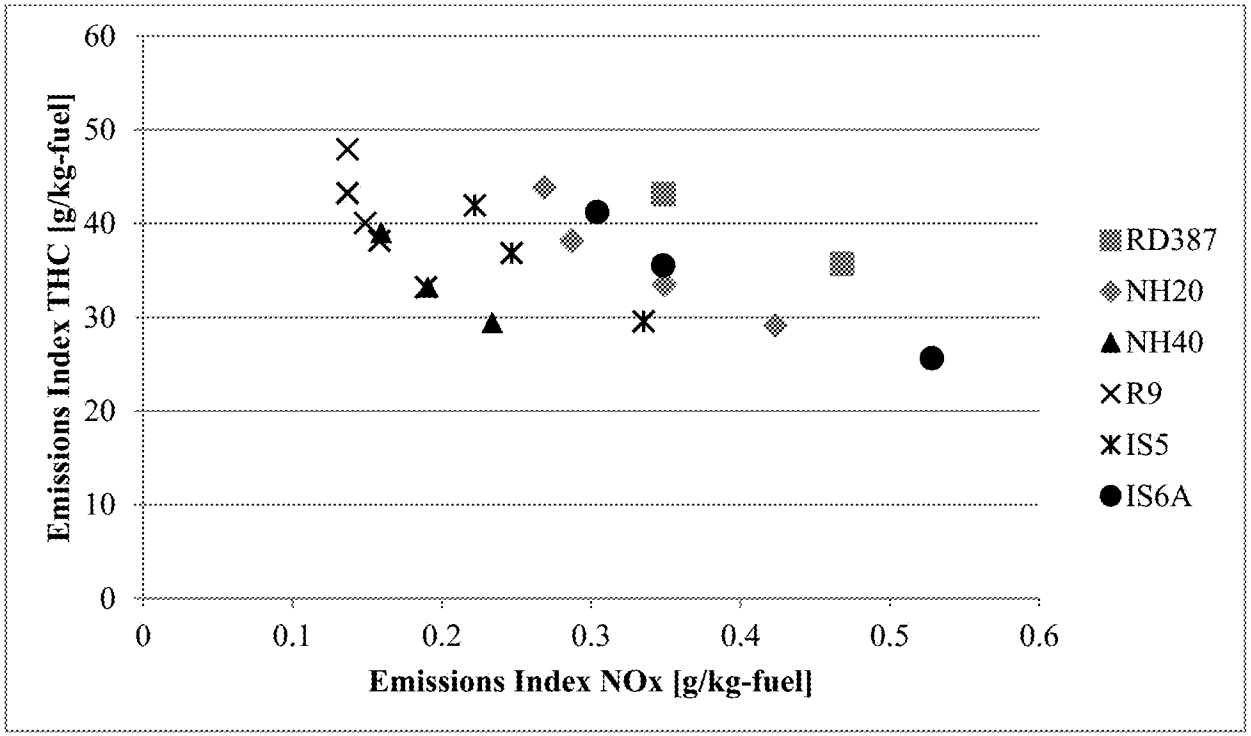
FIG. 6 is a graph depicting the emissions index of total hydrocarbons (THC) versus the emissions index of NO (g/kg−fuel) for several novel fuel blends during combustion in an HCCI engine.
Figure 7:
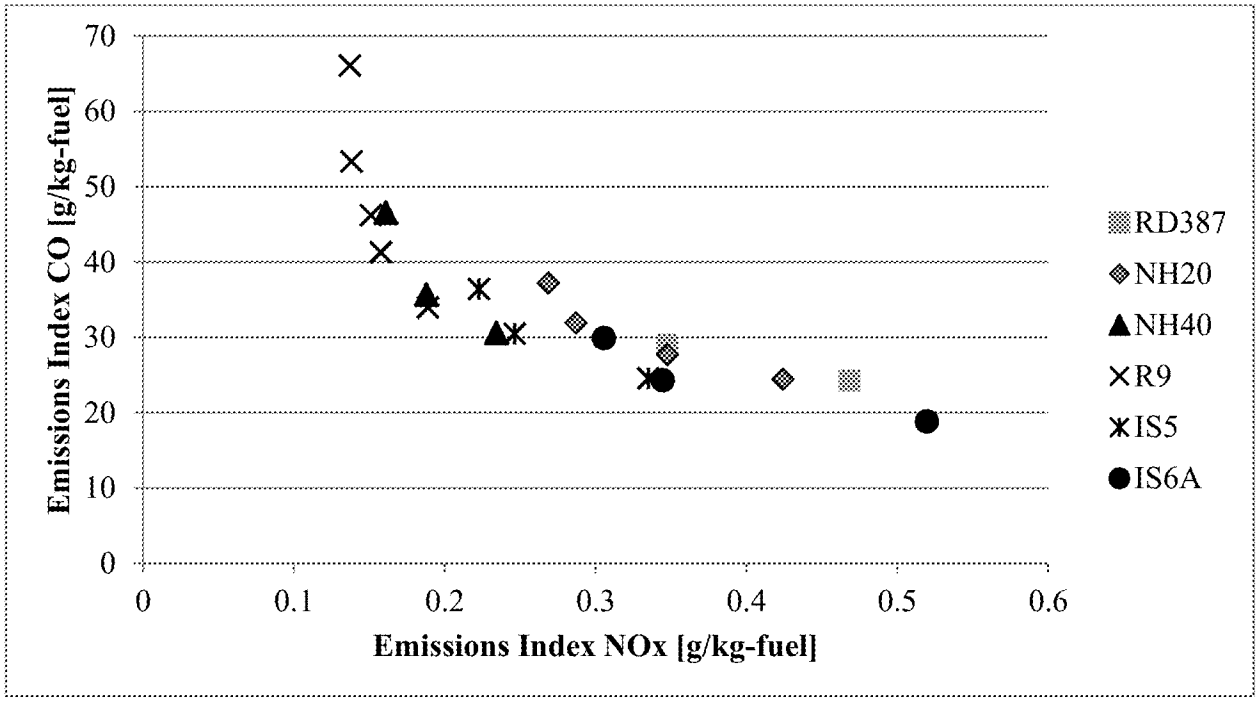
FIG. 7 is a graph depicting the emissions index of CO versus the emissions index of NO (g/kg−fuel) for several novel fuels blends during combustion in an HCCI engine.

For each test fuel, we also measured the emissions of total hydrocarbons (THC), nitric oxide (NO), and carbon monoxide (CO) in units of g/kg-fuel during combustion in the HCCI engine, where engine load was fixed at 9 bar. FIG. 6 plots the emissions index of THC versus the emissions index of NO, while FIG. 7 plots the emissions index of CO versus the emissions index of NO. Both figures demonstrate the R9 fuel blend to result in the lowest emissions of NO which is important due to engine NO emissions are highly regulated in most countries. In general, the lower octane number fuels can operate with less NO emissions because of less NVO required to enable auto-ignition, but they suffer higher CO and THC emissions.

In closing, it should be noted that the discussion of any reference is not an admission that it is prior art to the present disclosure, in particular, any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

1. Eng, J. A., Characterization of pressure waves in HCCI combustion, SAE Paper 2002-01-2859, (2002).

We claim:

1. A fuel for a homogeneous charge compression ignition engine, comprising:

(a) a mixture of hydrocarbons, each hydrocarbon in the mixture containing from 4 to 14 carbon atoms;

(b) at least 20 wt. % n-paraffins;

(c) at least 30 wt. % naphthenes;

(d) 20 wt. % or less of aromatic hydrocarbons;

(e) 5 wt. % or less of olefins.

2. The fuel of claim 1, wherein at least 90 wt. % of the mixture of hydrocarbons consists of hydrocarbons containing from 6 to 10 carbon atoms.

3. The fuel of claim 1, wherein at least 75 wt. % of the mixture of hydrocarbons consists of hydrocarbons containing from 7 to 9 carbon atoms.

4. The fuel of claim 1, wherein 15 wt. % or less of the hydrocarbons contain five or fewer carbon atoms.

5. The fuel of claim 1, wherein the fuel comprises at least 25 wt. % n-paraffins.

6. The fuel of claim 1, wherein the fuel comprises at least 30 wt. % of n-paraffins.

7. The fuel of claim 1, wherein the fuel comprises at least 35 wt. % of n-paraffins.

8. The fuel of claim 1, wherein the fuel comprises at least 35 wt. % naphthenes.

9. The fuel of claim 1, wherein the fuel comprises 15 wt. % or less of aromatic hydrocarbons.

10. The fuel of claim 1, wherein the fuel comprises 10 wt. % or less of aromatic hydrocarbons.

11. The fuel of claim 1, wherein the fuel additionally comprises 3 wt. % or less of olefins.

12. The fuel of claim 1, wherein the fuel additionally comprises 2 wt. % or less of olefins.

13. The fuel of claim 1, wherein the fuel additionally comprises 1 wt. % or less of olefins.

14. The fuel of claim 1, wherein the fuel possesses a dry vapor pressure equivalent of 10 psi (69 kPa) or less.

15. The fuel of claim 1, wherein the fuel possesses a dry vapor pressure equivalent 8 psi (55 kPa) or less.

16. The fuel of claim 1, wherein the quantity (wt. %) of naphthenes is greater than the quantity (wt. %) of normal paraffins.

17. A fuel for a homogeneous charge compression ignition engine, comprising:

(a) at least 90 wt. % hydrocarbons containing from six to ten carbon atoms;

(b) at least 20 wt. % normal paraffins;

(c) at least 30 wt. % naphthenes;

(d) 20 wt. % or less of aromatic hydrocarbons;

(e) 3 wt. % or less of olefins.

18. A fuel for a homogeneous charge compression ignition engine possessing a dry vapor pressure equivalent of 8 psi (55 kPa) or less, and comprising:

(a) hydrocarbons containing from 4 to 14 carbon atoms, wherein at least 75 wt. % of the hydrocarbons contain from 7 to 9 carbon atoms;

(b) at least 25 wt. % n-paraffins;

(c) at least 30 wt. % naphthenes;

(d) 15 wt. % or less of aromatic hydrocarbons;

(e) 3 wt. % or less of olefins.

* * * * *